US005765073A

United States Patent [19]

Schoenbach et al.

[11] Patent Number: 5,765,073

[45] Date of Patent: Jun. 9, 1998

[54] FIELD CONTROLLED PLASMA DISCHARGE PRINTING DEVICE

[75] Inventors: Karl H. Schoenbach, Norfolk, Va.; William C. Nunnally, Fort Worth, Tex.

[73] Assignee: Old Dominion University, Norfolk, Va.

[21] Appl. No.: 626,872

[22] Filed: Apr. 3, 1996

Related U.S. Application Data

[63] Continuation-in-part of Ser. No. 420,973, Apr. 10, 1995, Pat. No. 5,561,348.

[51] Int. Cl.[6] ..... G03G 15/043

[52] U.S. Cl. ..... 399/51; 315/169.1; 347/112; 399/220

[58] Field of Search ..... 399/51, 177, 220, 399/311, 4; 358/474, 296, 302; 315/169.1; 347/112

[56] References Cited

U.S. PATENT DOCUMENTS

| | | | |
|---|---|---|---|
| 3,875,422 | 4/1975 | Wasa et al. . | |
| 3,882,342 | 5/1975 | Kamegaya et al. . | |
| 3,952,221 | 4/1976 | Kamegaya et al. . | |
| 3,992,644 | 11/1976 | Chodil et al. . | |
| 4,021,695 | 5/1977 | Kamegaya et al. . | |
| 4,130,777 | 12/1978 | De Jule . | |
| 4,169,673 | 10/1979 | Sato et al. | 399/311 X |
| 4,227,114 | 10/1980 | De Jule . | |
| 4,229,766 | 10/1980 | Sipos . | |
| 4,322,659 | 3/1982 | De Jule et al. . | |
| 4,352,101 | 9/1982 | De Jule . | |
| 4,392,075 | 7/1983 | Kamegaya et al. . | |
| 4,472,659 | 9/1984 | Kamegaya et al. . | |
| 4,529,909 | 7/1985 | Kamegaya et al. . | |
| 4,563,081 | 1/1986 | Sato . | |
| 5,355,795 | 10/1994 | Moss et al. . | |
| 5,430,458 | 7/1995 | Weber . | |
| 5,561,348 | 10/1996 | Schoenbach et al. | 315/169.1 |

OTHER PUBLICATIONS

Richard C. Dorf, "*The Electrical Engineering Handbook*", CRC Press, pp. 1958–1964.

F. F. Mazda, "*Electronics Engineer's Reference Book*", Fifth Ed., Butterworths, pp. 61/3–61/11.

*Primary Examiner*—S. Lee

*Attorney, Agent, or Firm*—Jenkens & Gilchrist, P.C.

[57] ABSTRACT

A field controlled plasma discharge display element is disclosed for light source use in single element and multiple element plasma discharge electrostatic printers. The display element includes a pair of hollow discharge electric field electrodes, and a third electrode positioned external to and aligned with the discharge electric field electrodes for generating a control electric field proximate to the discharge electric field. The control electric field is used to control the intensity of the plasma discharge by distorting the shape of the generated discharge electric field. The single element plasma discharge device is modulated in accordance with the image to be printed and the modulated output is scanned across the photoconductive surface to produce the latent image. The multi-element matrix hollow cathode discharge device, on the other hand, generates the latent image on the photoconductive surface using either a line imaging (using a one by y matrix discharge device) effect or a page imaging (using an x by y matrix discharge device) effect.

27 Claims, 5 Drawing Sheets

FIELD CONTROLLED PLASMA DISCHARGE PRINTING DEVICE

CROSS-REFERENCE TO RELATED APPLICATION

This application for patent is a continuation-in-part of prior patent application Ser. No. 08/420,973, filed Apr. 10, 1995, U.S. Pat. No. 5,561,348, and entitled "Field Controlled Plasma Discharge Device" by Karl Schoenbach, et al.

BACKGROUND OF THE INVENTION

1. Technical Field of the Invention

The present invention relates to plasma discharge devices and, in particular, to a printer utilizing a plasma discharge device as its light source.

2. Description of Related Art

A plasma discharge device in its most simple single element form includes at least an anode electrode and a cathode electrode spaced apart from each other to define a discharge cell. A low pressure atmosphere of a gas mixture, typically including an ionizable inert (noble) gas, is maintained between the electrodes. When a sufficient potential is applied between the anode and cathode electrodes, an avalanche breakdown of the insulating properties of the gas occurs and a current flows between the electrodes forming a plasma discharge. The plasma discharge in the discharge cell comprises energetic electrons, excited atoms and ions.

The collision of the energetic electrons in the plasma discharge with the gas atoms maintained in the discharge cell ionizes the gas atoms, with the ionized gas atoms emitting a wide spectrum of radiation in the form of photons of light. The characteristics of the ionizable inert gas or mixture of gases maintained in the discharge cell dictate the dominant wavelength of the photons of light radiated from the discharge cell. For example, neon gas atoms will emit visible red-orange photons of light when excited by a plasma discharge. Xenon gas atoms, on the other hand, will emit primarily invisible ultraviolet photons of light that may be converted to visible light using UV-excitable phosphors.

The prior art further teaches the assembly of a plurality of individual discharge elements in a matrix configuration to form a panel plasma discharge display. In such multi-element plasma displays, a discharge cell is positioned at each of the points of intersection between orthogonally oriented rows and columns of wire conductors which comprise the anode and cathode electrodes. By selectively addressing the discharge cells through controlled application of a sufficient potential to individual ones of the orthogonal conductors, plasma discharges are generated in the discharge cells at the intersection points to produce a visible image having a predetermined two-dimensional shape.

The prior art further teaches the well known xerographic process for printing and copying. In accordance with that process, a latent electrostatic image of that which is desired to be printed or copied is generated on a photoconductive surface. Typically this is done by charging the photoconductive surface and then exposing the charged surface to either light reflected from the original to be copied or light modulated by the image to be printed and scanned across the charged surface. To develop the latent electrostatic image, toner comprising finely dispersed oppositely charged colored (generally black) particles is deposited through attraction on the photoconductive surface. The deposited toner is then transferred to an oppositely charged piece of paper through contact with the photoconductive surface and loose attraction of the deposited carbon black toner. The transferred carbon black is then fused to the surface of the paper using a combination of both heat and pressure to fix the printed image for viewing.

SUMMARY OF THE INVENTION

A field controlled, hollow cathode plasma discharge element is disclosed which includes a cathode electrode and an anode electrode sealed within an envelope filled with an ionizable mixture of gases. Aligned openings are provided in the cathode and anode electrodes forming hollow electrodes. The plasma discharge element further includes a field control electrode positioned within the sealed envelope adjacent to either the anode or cathode electrode. The three electrodes are spaced apart from each other to define a discharge cell through which a discharge electric field is generated, and within which a discharge electric field instigated plasma discharge occurs. The field control electrode generates a control electric field for distorting the shape of the discharge electric field and affecting the intensity of the plasma discharge. Varying the strength of the control electric field effectuates proportionate changes in the intensity of the plasma discharge current.

A multi-element, field controlled, hollow cathode plasma discharge panel is also provided wherein a plurality of the field controlled plasma discharge elements are arrayed in a matrix configuration and selectively addressed through individual field control electrodes to individually instigate and control the intensity of individual plasma discharges. Through sequential addressing, a visible image having a predetermined two-dimensional shape may be generated and displayed by the panel.

The present invention comprises the use of a plasma discharge, and in particular, the foregoing field controlled, hollow cathode plasma discharge devices in either their single element or multi-element matrix form as a light source in an electrostatic printing device. The single element plasma discharge device is modulated in accordance with the image to be printed and the modulated light output therefrom is scanned across the photoconductive surface to produce the latent image. The multi-element matrix hollow cathode discharge device, on the other hand, generates the latent image on the photoconductive surface from a discharge device output two dimensional image using either a line imaging (using a 1 by y matrix discharge device) effect or a page imaging (using an x by y matrix discharge device) effect. In either single element or multi-element printing device, the latent electrostatic image is developed by exposing the photoconductive surface to oppositely charged colored toner particles, transferring the attracted particles to a sheet of paper through contact with the photoconductive surface and electrostatic adhesion, and then fixing the transferred image on the paper using heat and/or pressure.

BRIEF DESCRIPTION OF THE DRAWINGS

A more complete understanding of the method and apparatus of the present invention may be had by reference to the following Detailed Description when taken in conjunction with the accompanying Drawings wherein.

DETAILED DESCRIPTION OF THE DRAWINGS

Figure 1:
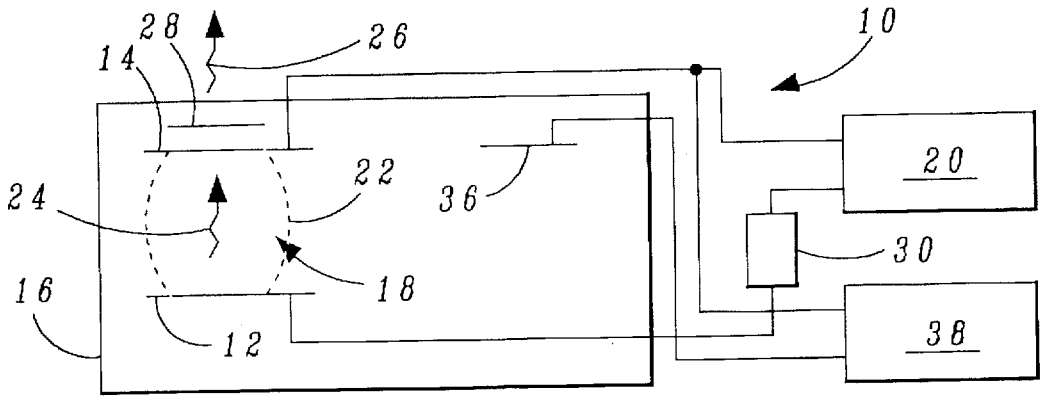
FIGURE 1 (PRIOR ART)
FIG. 1 is schematic diagram of a prior art plasma discharge display element.

Reference is now made to FIG. 1 wherein there is shown a schematic diagram of a prior art plasma discharge display element 10 including a cathode electrode 12 spaced apart from an anode electrode 14. The electrodes 12 and 14 are positioned within a glass envelope 16 that is sealed and filled with an ionizable inert gas. The area between the electrodes 12 and 14 comprises a discharge cell 18 wherein a plasma discharge is generated.

A voltage source 20 outputting a time dependent voltage (AC or DC) is connected to the electrodes 12 and 14 of the display element 10. Application of a voltage potential across the electrodes 12 and 14 generates an electric field (schematically illustrated by broken lines 22) in the discharge cell 18. When a sufficient potential is applied between the cathode electrode 12 and the anode electrode 14, a field instigated avalanche breakdown of the insulating properties of the gas atoms occurs and a current flows between the electrodes forming a plasma discharge. The plasma discharge contains energetic electrons, excited atoms and ions.

The collision of the energetic electrons in the plasma discharge with the ionizable gas atoms maintained in the discharge cell 18 excites the gas atoms into emission of a wide spectrum of radiation in the form of photons of light 24. The characteristics of the ionizable inert gas or mixture of gases that are sealed within the envelope 16 dictate the dominant wavelength of the photons of light 24 radiated from within the discharge cell 18. For example, neon gas atoms emit radiation in the visible red-orange spectrum when excited by a plasma discharge. Xenon gas atoms, on the other hand, emit radiation in the invisible ultraviolet spectrum. This invisible radiation is converted to visible photons of light 26 by phosphors 28 coated on the inside of the glass envelope 16.

Plasma discharges typically produce a negative differential resistance across the electrodes 12 and 14. To prevent the plasma discharge from transitioning to an arc that may destroy or damage the electrodes 12 and 14, the display element 10 and/or the voltage source 20, a current limiting impedance 30 is connected in series between the voltage source and one of the electrodes. When the voltage source 20 outputs alternating polarity voltage, the impedance 30 comprises a capacitor. A direct current output from the voltage source 20, on the other hand, requires the use of a resistor for the current limiting impedance 30.

In order for the radiated photons of light 24 and 26 to be better observed or detected outside the envelope 16, one of the electrodes 12 or 14 can be manufactured of a transparent material, such as tin oxide. The optical transmission efficiency of the materials used for a transparent conductive electrode, however, is unsatisfactory. One solution to this problem, as illustrated in the prior art hollow electrode plasma display element 32 shown in FIG. 2, is to provide an opening 34 in one of the electrodes (in this case, the anode electrode 14) through which the radiated photons of light 24 may escape from the discharge cell 18.

Figure 2:
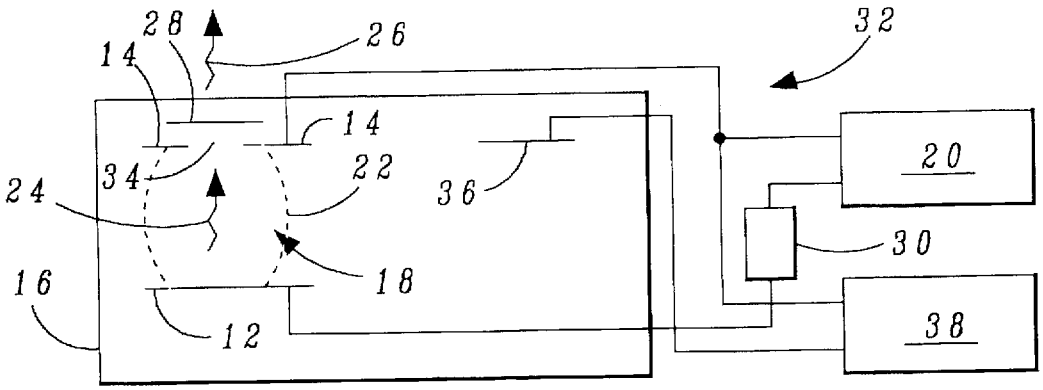
FIGURE 2 (PRIOR ART)
FIG. 2 is a schematic diagram of a prior art hollow electrode plasma discharge display element.

Reference is now made to both FIGS. 1 and 2. In many applications, it is desirable to quickly switch the plasma display element 10 or 32 between its off mode and its on (discharge) mode. However, there is a noticeable delay between application of the potential across the electrodes 12 and 14 and the generation of a plasma discharge within the discharge cell 18. To speed the reaction time of the plasma display elements 10 and 32, an additional, third electrode 36 is provided for generating free charges that seed the avalanche breakdown within the discharge cell 18 leading to a plasma discharge. The third electrode is connected to a voltage source 38.

Figure 3:
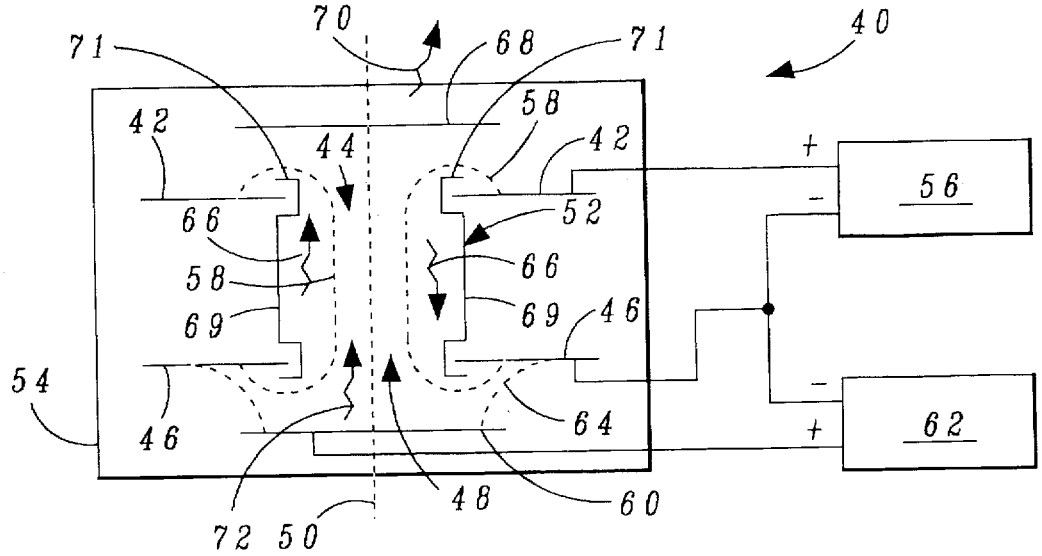
FIG. 3 is a schematic diagram of a field controlled, hollow cathode plasma discharge display element.

Reference is now made to FIG. 3 wherein there is shown a schematic diagram of a field controlled, hollow cathode plasma discharge element 40. The field controlled plasma discharge element 40 includes a hollow anode electrode 42 (having an opening 44) spaced apart from a hollow cathode electrode 46 (having an opening 48). The openings 44 and 48 in the pair of electrodes 42 and 46 are substantially aligned with each other along a common axis 50. The discharge element 40 further includes a third electrode 60 positioned adjacent to the anode electrode 42 or cathode electrode 46 to form a capacitor. The electrodes 42, 46 and 60 are positioned within an envelope 54 that is sealed and filled with an ionizable inert gas. If the element 40 functions as a display, the envelope 54 is manufactured of a transparent material.

The area between the electrodes 42, 46 and 60 around the common axis 50 comprises a discharge cell 52. A discharge voltage output from a first voltage source 56 is applied between the electrodes 42 and 46 to generate a discharge electric field (schematically represented by broken lines 58) within the discharge cell 52. Current flows between the pair of electrodes 42 and 46 following the field lines of the discharge electric field 58, the longest of which field lines pass through the openings 44 and 48 to terminate on the top side of the anode 42 and the bottom side of the cathode 46. Application of a sufficient discharge voltage potential to the pair of electrodes 42 and 46 instigates a plasma discharge in the discharge cell 52. The intensity of the plasma discharge depends on the amount of current flowing between the pair of electrodes 42 and 46.

The plasma discharge instigated in the hollow cathode, discharge element 40, unlike that with the prior art plasma discharge display of FIG. 1, has a positive differential resistance. The differential resistance of a hollow cathode plasma discharge will remain positive for low currents, and thus a series connected current limiting inductance (see FIG. 1) need not be included between the electrodes and the first voltage source 56. Because the differential resistance remains positive, a plurality of discharge elements 40 may be electrically connected in parallel with each other without danger of current diversions to adjacent discharge elements.

The third electrode 60 is oriented substantially parallel to the pair of electrodes 42 and 46, and is positioned external to the electrodes 42 and 46 in alignment with the openings 44 and 48 along the common axis 50. The placement of the third electrode 60 in the display element 40 forms a capacitor between the third electrode and the cathode electrode 46. It will, of course, be understood that the third electrode 60 could alternatively be positioned adjacent the anode electrode 42 if desired. A control voltage output from a second voltage source 62 is applied between the third electrode 60 and the cathode electrode 46 to generate a control electric field (schematically represented by broken lines 64). The control electric field 64 interacts with and, depending on its strength, distorts the shape of the discharge electric field 58. Such distortions in the shape of the discharge electric field 58 affect the amount of current flowing between the anode electrode 42 and the cathode electrode 46, and thus influence the intensity of the plasma discharge. Experimentation has shown that voltages in the range of as low as thirty volts applied to the control electrode 60 effectuate substantially linear control over current versus voltage in a four-hundred volt output voltage across the anode and cathode electrodes 42 and 46. With decreased spacing between the control electrode 60 and the cathode electrode 46, control voltages less than thirty volts may be used. Varying the control voltage potential applied to the third electrode 60 alters the discharge electric field 58 spatial distribution passing through the openings in the anode and cathode electrodes. Such changes cause corresponding variances in the flow of current between the electrodes 42 and 46 to effectuate proportionate changes in the intensity of the plasma discharge.

The collision of energetic electrons in the plasma discharge with the gas mixture maintained in the discharge cell 52 excites the ionizable gas atoms into emission of a wide spectrum of radiation in the form of photons of light 66. The hollow cathode geometry with openings 44 and 48 in both of the electrodes 42 and 46 disperses the area in which such electron and ion interaction with the electrodes occurs, and thus reduces erosion to facilitate a longer operating lifetime for the discharge element 40.

In a light emitting display application, a coating of phosphor 68 is provided on the glass envelope 54 to absorb the invisible photons 66 of ultraviolet radiation and emit visible photons of light 70. The third electrode 60 may also be coated with phosphor 72 to absorb rearwardly directed ultraviolet photons 66 and emit visible photons 70 thus increasing the overall optical efficiency of the discharge element 40. Furthermore, the anode and cathode electrodes 42 and 46 may be coated with UV converting phosphor 69. In addition, the top surface of the anode electrode 42 may be coated with an electron phosphor 71 to absorb electrons accelerated along the field lines 58 and re-radiate visible light. The brightness of the visible light emitted by the discharge element 40 is directly proportional to the intensity of the plasma discharge current, and thus the brightness of the light is controlled by varying the control voltage potential output by the second voltage source 62.

Figure 4:
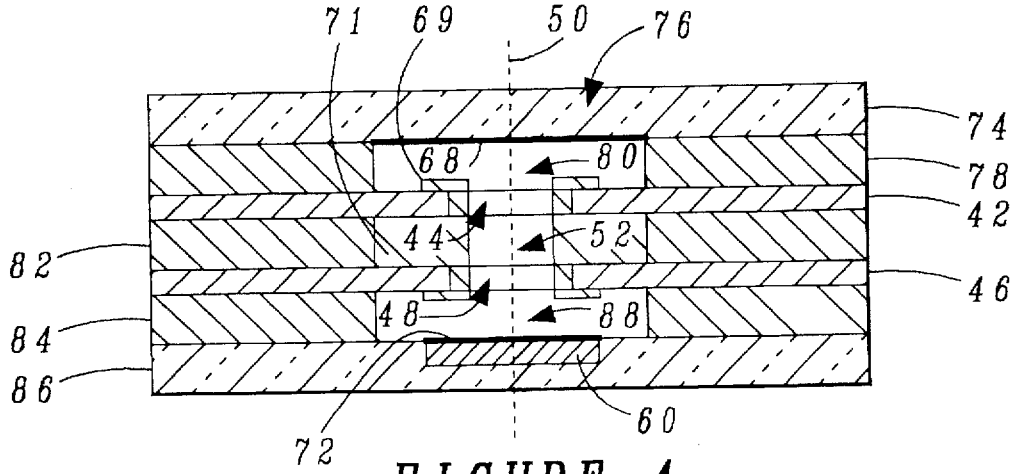
FIG. 4 is a cross-sectional view of the display element of FIG. 3.

Reference is now made to FIG. 4 wherein there is shown a cross-sectional view of the hollow cathode discharge element 40 schematically illustrated in FIG. 3. The glass envelope 54 comprises a transparent front plate 74 forming a viewing window 76 for the discharge element 40 through which any visible light generated by a plasma discharge may be observed. Phosphor 68 for converting plasma discharge generated ultraviolet photons to visible light is coated to a back surface of the front plate 74 in the area of the viewing window 76. A spacer 78 of suitable dielectric or other insulating material is positioned between the front plate 74 and the anode electrode 42. The top surface of the anode electrode 42 may further include a deposit of an electron phosphor 71 for converting electron energy to visible light. This phosphor 71 must be made electrically conductive (perhaps through incalulating the phosphor in a fullerene tube matrix) to conduct the electric charge to the electrode 42. An opening 80 is provided in the spacer 78 substantially aligned with the opening 44 in the anode electrode 42 along common axis 50. The opening 80 in the spacer 78, however, has a larger diameter than the opening 44 in the anode electrode 42. A spacer 82 of suitable dielectric or other insulating material is positioned between the anode electrode 42 and the cathode electrode 46 to maintain a separation between the electrodes approximately equal to the diameter of the openings 44 and 48. An opening, substantially aligned along common axis 50 and having a diameter larger than the openings 44 and 48 in the electrodes 42 and 46, is provided in the spacer 82. The anode and cathode electrodes 42 and 46 may be coated with a phosphor 69 for converting ultraviolet plasma radiation to visible light. A spacer 84 of suitable dielectric or other insulating material is positioned between the cathode electrode 46 and a back plate 86 of the glass envelope 54. An opening 88, substantially aligned along common axis 50 and having a diameter larger than the openings 44 and 48 in the electrodes 42 and 46, is provided in the spacer 84. The third electrode 60 is positioned on a front surface of the back plate 86 substantially aligned with the openings 44 and 48 in the electrodes 42 and 46 and positioned at a location opposite the viewing window 76 along common axis 50. Phosphor 72 for converting rearwardly directed plasma discharge generated ultraviolet photons to visible light may be coated to a front surface of the third electrode 60.

Figure 5:
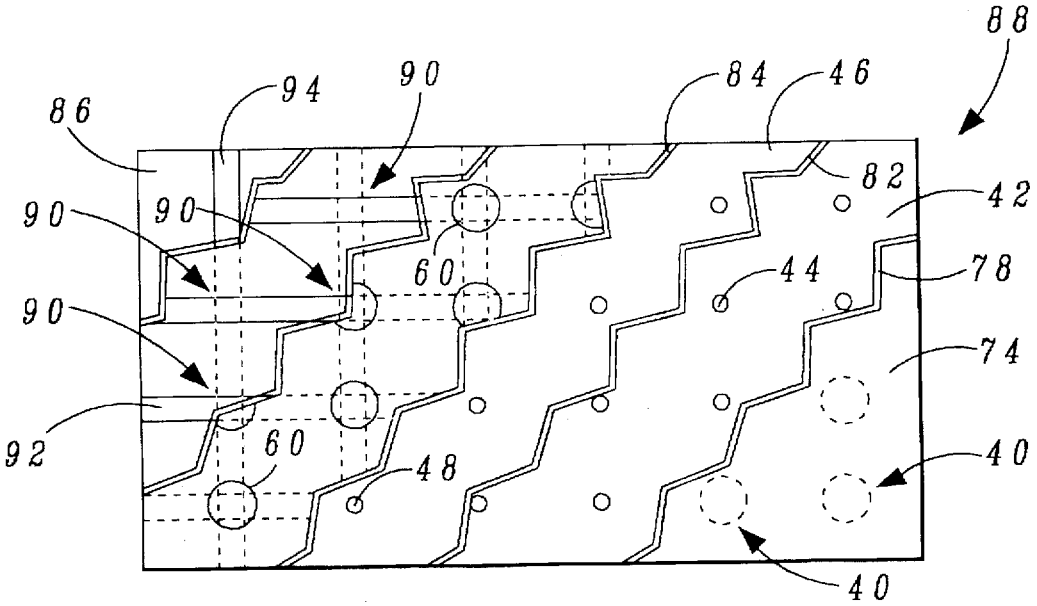
FIG. 5 is partially broken away top view of a multi-element field controlled flat panel display.

Reference is now made to FIG. 5 wherein there is shown a partially broken away top view of a multi-element field controlled panel discharge device 88. The discharge device 88 comprises a plurality of discharge elements 40 (FIGS. 3 and 4) arrayed in a row by column matrix configuration. Individual elements 40 in the device 88 are located at the points of intersection 90 between individual ones of a set of "x" control lines 92 and individual ones of a set of "y" control lines 94. Actuation of the elements 40 in the device 88 is effectuated by selectively addressing the x control lines 92 and the y control lines 94. Only at that one element 40 positioned at the point of intersection 90 between two addressed control lines 92 and 94 will a plasma discharge (producing a light emission) be instigated by changing the control electrode voltage. To generate a two dimensional visual image with the device 88, the control lines 92 and 94 are sequentially and repeatedly addressed in proper order to generate light emissions at the proper locations on the device 88. It will, of course, be understood that the panel device 88 may be fabricated to have either a flat or curved surface and to produce either color or black and white images.

The set of y control lines 94 are provided in a common plane and positioned above (i.e., on top of) the back plate 86. The set of x control lines 92 are also provided in a common plane and are positioned spaced apart from and above the y control lines 94. The plurality of third electrodes 60 comprise conducting disks that are also provided in a common plane positioned spaced apart from and above the x control lines 92. The x and y control lines 92 and 94 are connected or coupled to the third electrodes 60 by means of a control circuit (not shown, see FIGS. 6 and 7).

The cathode electrode 46 comprises a conducting plane including the plurality of openings 48 arrayed in the matrix configuration. The cathode electrode 46 conducting plane is positioned above the third electrodes 60 and separated therefrom by means of the spacer 84. The anode electrode 42 is similarly formed of a conducting plane including the plurality of openings 44 arrayed in the matrix configuration corresponding in location to the openings 48 in the cathode electrode 46. The anode electrode 42 conducting plane is positioned above the cathode electrode 46 conducting plane and separated therefrom by means of the spacer 82. The front plate 74 is positioned above and separated from the anode electrode 42 conducting plane by the spacer 78.

Figure 6:
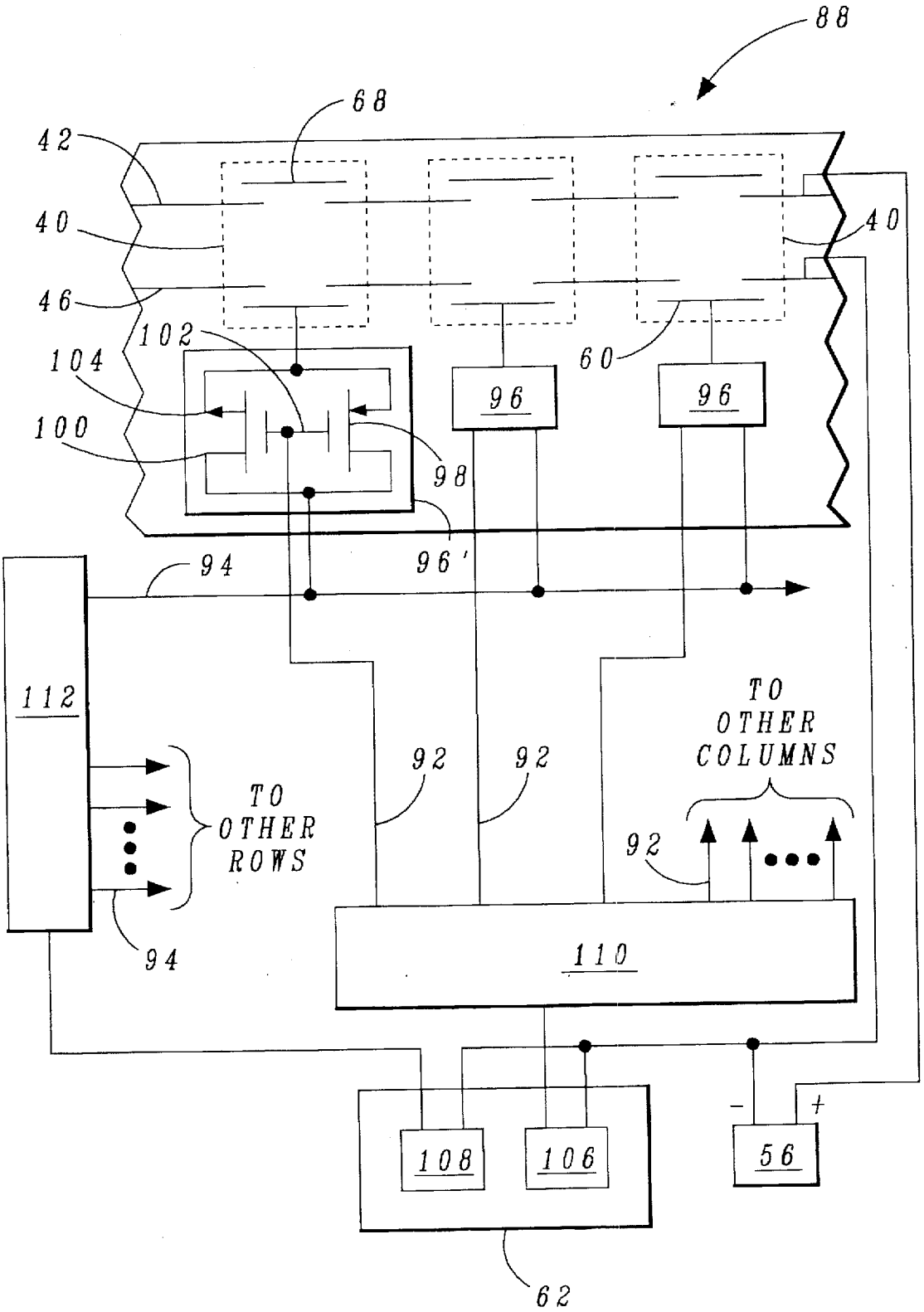
FIG. 6 is a schematic diagram of the multi-element field controlled flat panel display shown in FIG. 5 using an active FET circuit for controlling actuation of each discharge device.

Reference is now made to FIG. 6 wherein there is shown a schematic diagram of the multi-element field controlled panel discharge device 88. For simplification of this drawing, only three elements 40 in a single row of the device 88 are illustrated.

The x and y control lines 92 and 94 are connected to the third electrodes 60 by means of a bi-directional control circuit 96 for controlling the flow of current into and out of the capacitance formed between the control electrode 60 and the cathode electrode 46. Each of the control circuits 96 in a given column of the device 88 are connected to a single one of the x control lines 92 corresponding to that column. Similarly, each of the control circuits 96 in a given row of the device 88 are connected to a single one of the y control lines 94 corresponding to that row.

In one embodiment, the control circuit 96 comprises a "set and leave" circuit 96' including a pair of interconnected field effect transistors (FETs) 98 that are used to control the voltage on the field control electrode 60. Each FET 98 includes a drain terminal 100, a gate terminal 102 and a source terminal 104. In each control circuit 96', the drain terminals 100 of the pair of included FETs 98 are connected to each other and to the y control line 94 for the row in which the display element 40 is located. The gate terminals 102 of the pair of included FETs 98 are connected to each other and to the x control line 92 for the column in which the display element 40 is located. The source terminals 104 of the pair of included FETs 98 are also connected to each other, and are further connected to the third electrode 60 of the display element 40.

In the panel device 88, the second voltage source 62 comprises a gate voltage supply 106 and a drain voltage supply 108. The gate voltage supply 106 is selectively connected to each of the control circuits 96' (via the connected FET 98 gate terminals 100) through a column switching circuit 110 and the x control lines 92. The drain voltage supply 108, on the other hand, is selectively connected to each of the control circuits 96' (via the connected FET 98 drain terminals 102) through a row switching circuit 112 and the y control lines 94. The switching circuits 110 and 112 operate to select a discharge element 40 in the device 88 for activation by addressing an x and y control line 92 and 94 for application of the voltages output from the gate voltage supply 106 and the drain voltage supply 108, respectively. Application of voltages of the same polarity to the control circuit 96' actuates the discharge element 40 located at the intersection point 90 between the selected control lines 92 and 94, changes the field control electrode 60 voltage and instigates a plasma discharge. The intensity of the discharge (and accordingly the brightness of the emitted visible light) is controlled by varying the relative voltages output from the supplies 106 and 108.

The control circuit 96' is advantageously placed at the rear of the device 88. Placement at this location facilitates manufacture of the device 88 as the control circuit 96' and its associated control lines 92 and 94 can be separately manufactured as one unit, tested, and only thereafter mounted to the remainder of the device components. The placement at the rear of the device 88 further obviates the need to use expensive thin film fabrication techniques historically needed for fabricating the transparent control circuits placed in front of other display devices like liquid crystal displays. Furthermore, with rear placement, redundant electronic components (for example, the FETs) can be fabricated and later activated through known laser selection techniques in the event the primary components subsequently fail or are initially defective.

Figure 7:
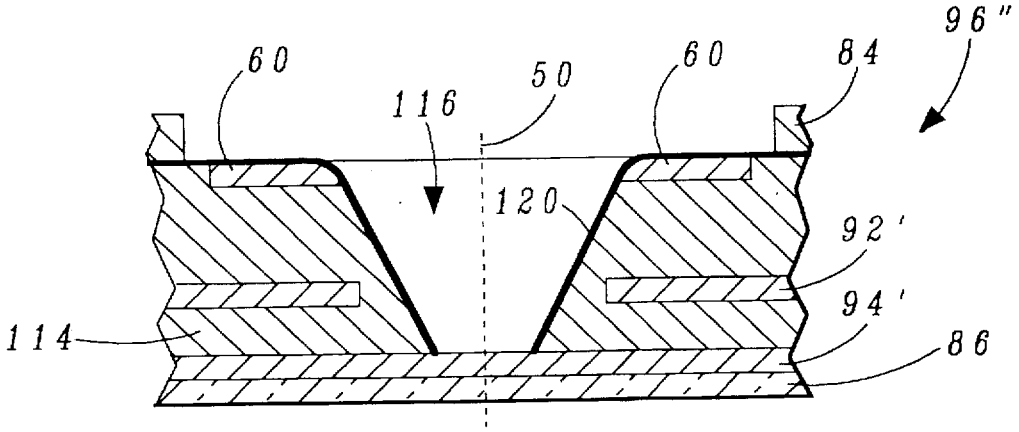
FIG. 7 is a cross-sectional view of an active surface field effect device for controlling actuation of each discharge device.

Reference is now made to FIG. 7 wherein there is shown a cross-sectional view of an alternative embodiment 96" of the bi-directional control circuit 96 illustrated in FIG. 6. The control circuit 96" comprises an active surface field effect device that does not utilize semiconductor devices (like the FETs 98) for controlling actuation of the discharge element 40. Instead, the control circuit 96" comprises layers of insulators and conductors that are more easily and reliably fabricated than semiconductor devices.

The control circuit 96" includes a voltage source electrode 94' comprising the y control line, and a gate electrode 92' comprising the x control line. The voltage source electrode 94' is positioned above (i.e., on top of) the back plate 86. The gate electrode 92' is positioned above and is spaced apart from the voltage source electrode 94' by an insulating spacer 114 which also separates the gate electrode 92' from the third electrode 60 of the discharge element 40. Openings are formed in the third electrode 60, gate electrode 92' and spacer 114 to define a conically-shaped aperture 116. The aperture 116, as well as the front surface 118 of the third electrode 60, is coated with an insulating layer 120 comprising, for example, magnesium oxide. The insulating layer 120 functions to reduce secondary electron emission. Although exposed by the aperture 116, the surface of the voltage source electrode 94' need not be coated with the insulating layer 120.

The photons of light and ions generated in the discharge cell 52 of discharge element 40 produce a layer of surface charge on the insulator layer 120. Altering the potentials applied to the third electrode 60, voltage source electrode 94', and the gate electrode 92' controls the movement of the layer of surface charge. Thus, the control circuit 96" comprises a field effect device similar in operation to a field effect transistor.

Figure 8:
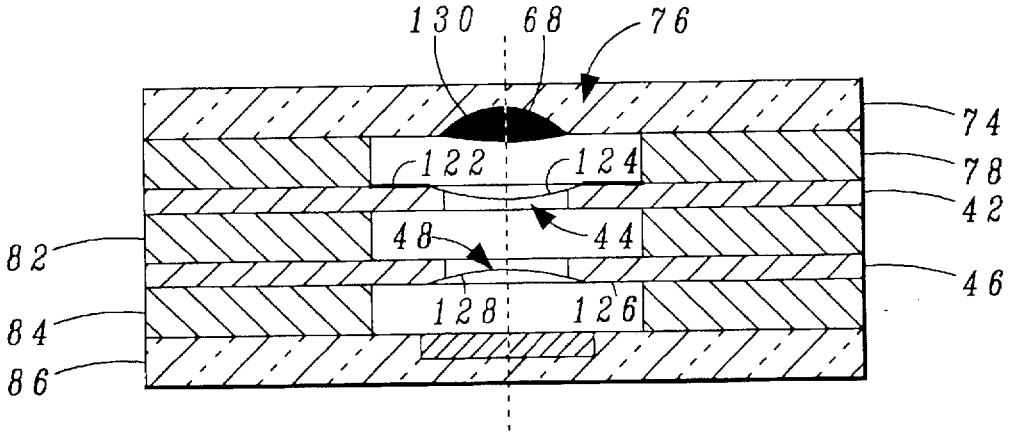
FIG. 8 is a cross-sectional view of the plasma discharge device illustrating geometry variations for the field generation electrodes and phosphor coating.

Referring now to FIG. 8, there is shown in cross-section an alternative geometry for the electrodes 42 and 46 and the phosphor coating 68 of the plasma discharge device 40. A front surface 122 of the anode electrode 42 at the opening 44 is contoured to define a concave surface 124. Preferably the concave surface 124 is polished to reflect rearwardly directed photons of light out through the viewing window 76. A rear surface 126 of the cathode electrode 46 is similarly contoured and polished to define a concave, light reflecting surface 128. In order to increase the contrast of the discharge element 40 for use as a light emitting display, the remainder of the front surface 122 of the anode electrode 42 outside of the concave surface 124 is coated in a black or otherwise spectrally absorptive color. A concave surface 130 is further formed in the front plate 74 at the viewing window 76. The phosphor coating 68 for converting ultraviolet to visible light is lens-shaped and contoured to conform to the concave surface 130. The lens shape of the phosphor 68 and concave surface 130 at the viewing window 76 improve directivity of the produced visible light as well as enhance the efficiency of the ultraviolet-to-visible light conversion.

Figure 9:
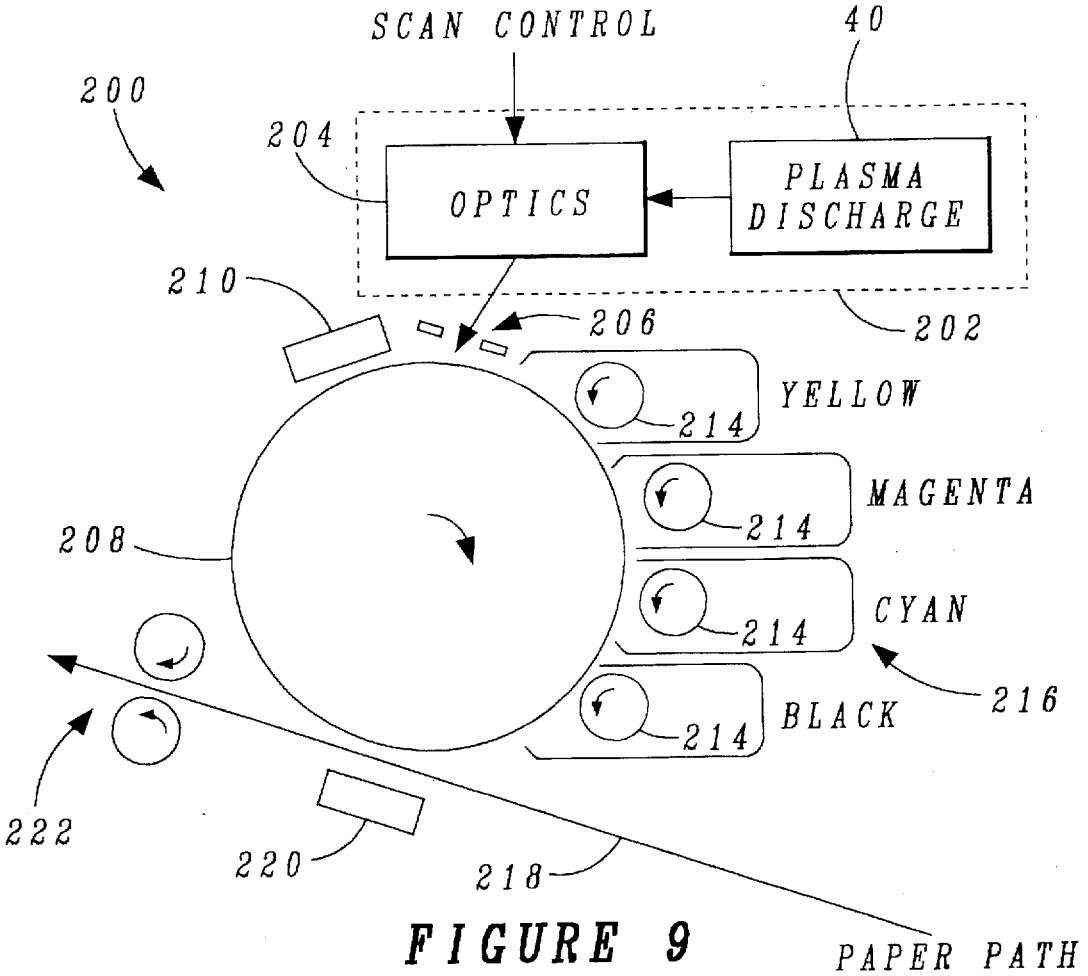
FIG. 9 is a schematic diagram of a single element plasma discharge electrostatic printing device.

Reference is now made to FIG. 9 wherein there is shown a schematic diagram of a single element plasma discharge electrostatic printing device 200 which operates in a manner analogous to a laser printer. In the device 200, however, the print head 202 comprises a single element plasma discharge element 40, like that shown in FIGS. 3 and 4, for its light source instead of a solid state laser or gas laser as is known in the art. The print head 202 further includes well known imaging optics 204 comprising lenses (e.g., beam expanders) and scanners (e.g., rotating polygons) operating to focus and line scan the single beam modulated light output from the discharge element 40 along an imaging slot 206 and onto a rotating photoconductive drum 208. In this device, the light output from the discharge element 40 is modulated by the information comprising the image to be printed.

Prior to being imaged, the photoconductive drum 208 is charged over a uniform area with ions emitted from a corotron/scorotron 210. The corotron/scorotron 210 comprises one or more thin corona wires supported directly above and extending laterally across the surface of the photoconductive drum 208. Positively or negatively charged ions are attracted to the outer surface of the photoconductive drum 208 which, when subsequently exposed to the scanned light emitted from the plasma discharge device 40, acts for a short period of time as an insulator depending on the sign of the potential difference. When exposed to light, voltage decay occurs due to photon absorption by the surface of the photoconductive drum 208 to generate electron-hole pairs. These pairs separate under the influence of the uniform charge deposited by the corotron/scorotron 210 neutralizing the charge and generating on the drum 208 a latent electrostatic image of the image to be printed.

To develop the latent image, colored toner particles are charged to a polarity opposite that of the surface of the photoconductive drum 208. A magnetic brush 214 is then used to apply the toner particles to the surface of the photoconductive drum 208 where they electrostatically adhere to those areas with an opposite charge (i.e., those areas exposed to the modulated and scanned light output from the plasma discharge device 40). To develop a color latent image, multiple development stations 216 are needed, one each for the subtractive colors (cyan, yellow and magenta) and one for black. The four component latent images may be accumulated on the photoconductive drum 208 if desired.

The developed image present on the drum 208 is then transferred to the paper 218 using a corotron 220. The corotron 220 sprays ionized charge on the back side of the paper 218, with the ionized charge being of the opposite polarity as the toner particles deposited on the drum surface. The toner particles then electrostatically (i.e., loosely) adhere to the paper surface. Fusing of the toner particles, and hence the developed and transferred image, to the paper 218 is accomplished by the use of heat, pressure, or combination heat and pressure as generally indicated at 222.

Figure 10:
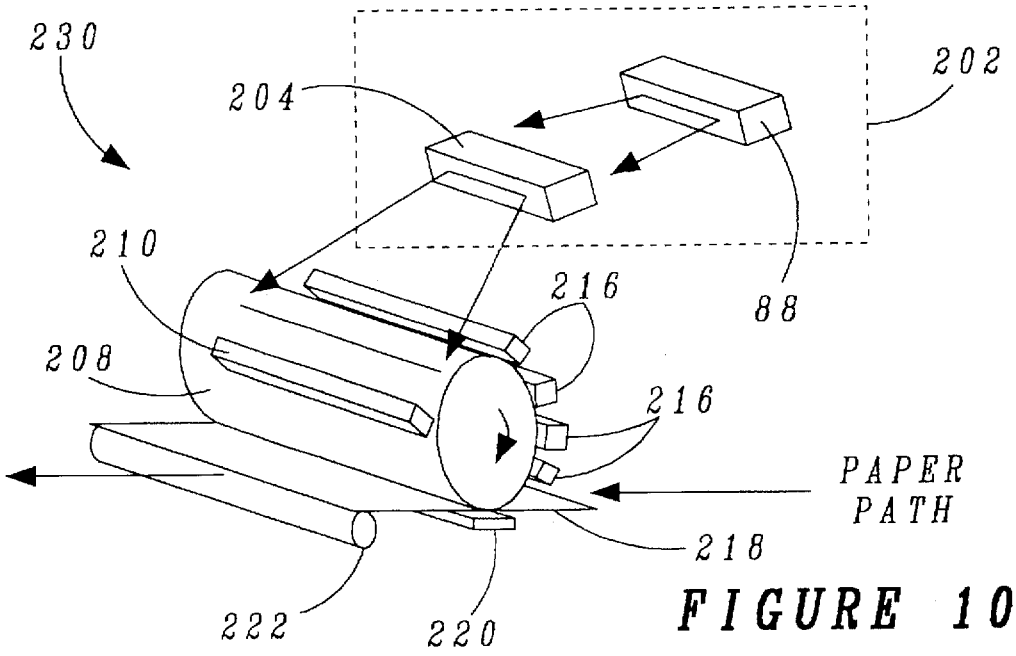
FIG. 10 is a schematic diagram of a multi-element plasma discharge, line-imaging electrostatic printing device.

Reference is now made to FIG. 10 wherein there is shown a schematic diagram of a multi-element plasma discharge, line-imaging electrostatic printing device 230. Like or similar reference numerals in FIGS. 9 and 10 refer to like or similar components. The device 230 operates in a manner analogous to a laser printer or photocopier. In the device 230, however, the print head 202 comprises a linear, multi-element plasma discharge panel 88, like that shown in FIG. 5 (comprising however a linear 1 by y matrix), instead of a linear solid state laser or gas laser array or page/line imaging and scanning optics. The print head 202 further includes well known imaging optics 204 operating to focus the line of light output from the linear discharge panel 88 through an imaging slot 206 and onto a rotating photoconductive drum 208. The generation of the latent image on paper 218 through charging of the drum 208, development 216, transfer with the corotron 220 and fusing 222 occurs after imaging in the manner well known in the art and described above in connection with FIG. 9.

Figure 11:
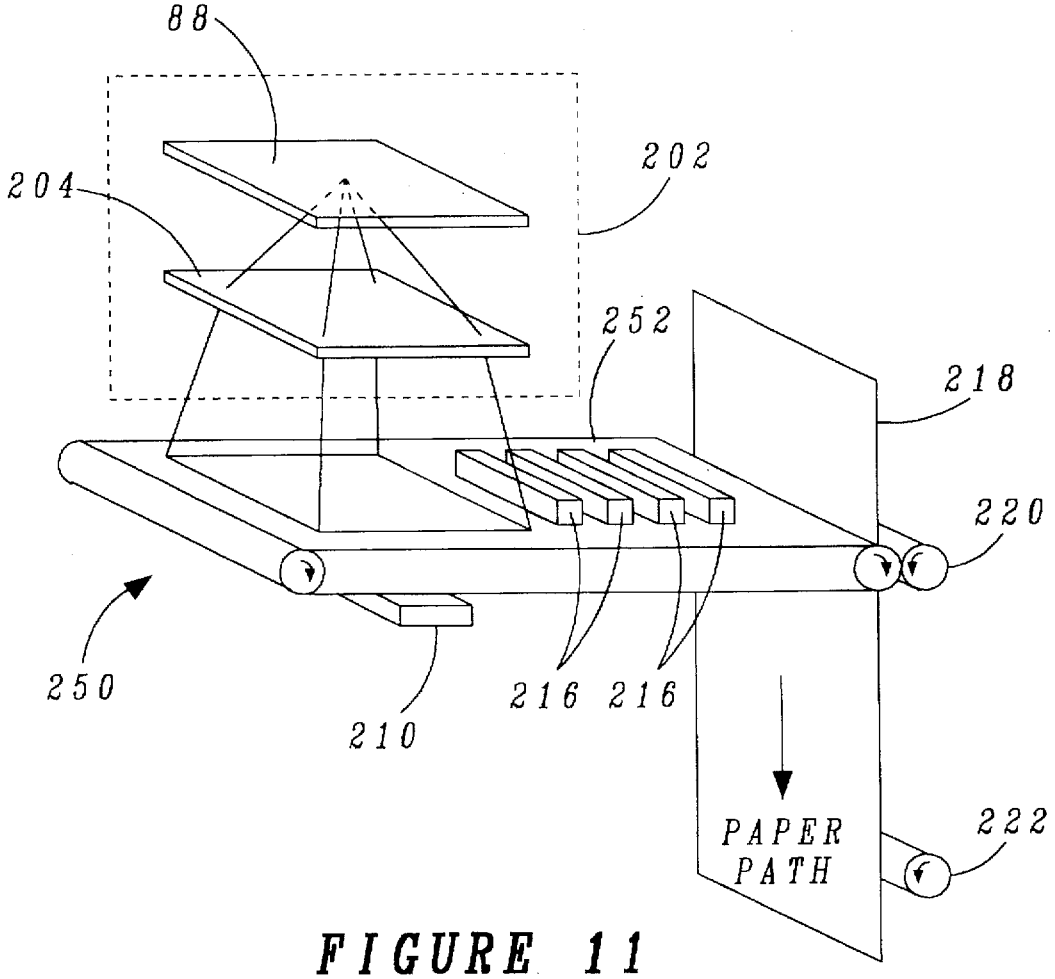
FIG. 11 is a schematic diagram of a multi-element plasma discharge, page-imaging electrostatic printing device.

Reference is now made to FIG. 11 wherein there is shown a schematic diagram of a multi-element plasma discharge, page-imaging electrostatic printing device 250. Like or similar reference numerals in FIGS. 9 and 10 refer to like or similar components. The device 250 operates in a manner analogous to a laser printer or photocopier. In the device 230, however, the print head 202 comprises a multi-element plasma discharge panel 88, like that shown in FIG. 5 (comprising an x by y matrix) that generates a visible display of all or part of the image to be printed. The print head 202 further includes imaging optics 204 operating to focus the light comprising the panel image light output from the discharge panel 88 onto a photoconductive substrate 252. The substrate 252 preferably comprises a drum (not shown, see FIGS. 9 and 10) or flexible belt (shown) charged with ions as discussed above. The generation of the latent image on paper 218 through development with the magnetic brush (es) 214, transfer with the corotron 220 and fusing 222 occurs after imaging in the manner well known in the art and described above in connection with FIG. 9.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. An electrostatic printing device, comprising:

a field controllable plasma discharge device for outputting light relating to an image to be printed;

a charged photoconductive surface;

means for directing the output light from the field controllable plasma discharge device onto the charged photoconductive surface to generate thereon a latent electrostatic image of the image to be printed;

means for developing the latent electrostatic image on the charged photoconductive surface; and means for transferring the developed latent electrostatic image to, and fixing the developed latent electrostatic image on a media for viewing.

2. The printing device of claim 1 wherein the plasma discharge device comprises a single element field controllable plasma discharge display.

3. The printing device of claim 2 wherein the single element field controllable plasma discharge display comprises:

a sealed envelope containing an inert gas;

a pair of hollow field generation electrodes positioned within the sealed envelope, the hollow field generation electrodes generating, in response to the application of a first potential thereto, a discharge electric field that induces a plasma discharge; and a control electrode positioned within the sealed envelope external to the field generation electrodes, the control electrode generating, in response to the application of a second potential thereto, a control electric field for distorting a shape of the generated discharge electric field and affecting an intensity of the induced plasma discharge and the output light therefrom.

4. The printing device of claim 3 further including means for varying a strength of the second potential, such variances in the second potential affecting discharge electric field distortion and causing proportionate changes in the intensity of the induced plasma discharge and the output light.

5. The printing device of claim 2 wherein the means for directing comprises imaging optics for focusing and scanning the output light from the single element field controllable plasma discharge display across the charged photoconductive surface.

6. The printing device of claim 1 wherein the charged photoconductive surface comprises a rotating photoconductive drum.

7. The printing device of claim 1 wherein the plasma discharge device comprises a multi-element field controllable plasma discharge display.

8. The printing device of claim 7 wherein multi-element field controllable plasma discharge display, comprising:

a plurality of plasma discharge cells arrayed in a row by column matrix configuration;

a pair of hollow electrodes for each discharge cell, the pair of hollow electrodes generating, in response to a first potential, a first electric field in a gas atmosphere;

a plurality of control electrodes, one for each discharge cell, each control electrode generating, in response to a second potential, a second electric field proximate to the first electric field;

means for selectively instigating plasma discharges at selected discharge cells and generate a two-dimensional image; and means for varying a strength of the second electric field to distort a shape of the first electric field and effectuate proportionate changes in an intensity of the instigated plasma discharges and the output light therefrom comprising a two-dimensional image.

9. The printing device of claim 8 wherein the row by column matrix configuration comprises one row/column by multi-columns/rows.

10. The printing device of claim 9 wherein the means for directing comprises imaging optics for focusing output light of the two-dimensional image from the one row/column by multi-columns/rows multi-element field controllable plasma discharge display device on to the charged photoconductive surface.

11. The printing device of claim 8 wherein the row by column matrix configuration comprises multi-rows/columns by multi-columns/rows.

12. The printing device of claim 11 wherein the means for directing comprises imaging optics for focusing output light of the two-dimensional image from the multi-rows/columns by multi-columns/rows multi-element field controllable plasma discharge display on to the charged photoconductive surface.

13. An electrostatic printing method, comprising the steps of:

charging a photoconductive surface;

generating a light output from a plasma discharge that is induced by a variably controlled electric field;

directing the light output from the plasma discharge to the charged photoconductive surface to create a latent electrostatic image thereon;

developing the latent electrostatic image on the photoconductive surface;

transferring the developed image from the photoconductive surface to a media; and fixing the transferred image on the media for viewing.

14. The printing method of claim 13 wherein the step of generating a light output from a plasma discharge comprises the steps of:

generating a first electric field in an environment of an ionizable gas, said first electric field of sufficient strength to initiate a plasma discharge producing light output;

generating a second electric field proximate to the first electric field; and varying a strength of the generated second electric field to cause distortions in a shape of the proximately located first electric field that effectuate proportionate changes in an intensity of the initiated plasma discharge and the generated light output.

15. The printing method of claim 13 wherein the step of generating a light output comprises the step of generating the light output from a single element source, and the step of directing the light output to the charged photoconductive surface comprises the steps of:

focusing the light output on the charged photoconductive surface; and scanning the focused light output across the charged photoconductive surface.

16. The printing method of claim 13 wherein the step of generating a light output comprises the step of generating the light output from a line element source, and the step of directing the light output to the charged photoconductive surface comprises the step of focusing a line of light output on the charged photoconductive surface.

17. The printing method of claim 13 wherein the step of generating a light output comprises the step of generating the light output from a panel element source, and the step of directing the light output to the charged photoconductive surface comprises the step of focusing a panel of light output on the charged photoconductive surface.

18. The printing method of claim 13 wherein the step of generating a light output from a plasma discharge comprises the steps of:

applying a first potential to a pair of field generation electrodes of sufficient strength to generate an electric field that induces a plasma discharge;

applying a second potential to an adjacent control electrode to generate a control electric field proximate to the plasma discharge inducing electric field; and varying a strength of the second potential to cause distortions in a shape of the generated plasma discharge inducing electric field that effectuate proportionate changes an intensity of the induced plasma discharge and light output produced therefrom.

19. A device for producing latent electrostatic images, comprising:

a photoconductive surface;

means for charging the photoconductive surface;

a field controllable plasma discharge device for generating a light output; and optics for directing the light output from the field controllable plasma discharge device onto the charged photoconductive surface to form a latent electrostatic image thereon.

20. The device of claim 19 wherein the field controllable plasma discharge device comprises a single element variable output plasma discharge.

21. The device of claim 20 wherein the single element variable output plasma discharge comprises:

a plasma discharge cell;

a pair of hollow electrodes for the discharge cell, the pair of hollow electrodes generating, in response to a first potential, a first electric field in a gas atmosphere that instigates a plasma discharge;

a control electrode in the discharge cell for generating, in response to a second potential, a second electric field proximate to the first electric field; and means for varying a strength of the second electric field to distort a shape of the first electric field and effectuate proportionate changes in an intensity of the instigated plasma discharge and the light output generated thereby.

22. The device of claim 20 wherein the optics comprise means for focusing and scanning the light output from the single element variable output plasma discharge on and across the charged photoconductive surface to generate the latent electrostatic image thereon.

23. The device of claim 19 wherein the field controllable plasma discharge device comprises a multi-element variable output plasma discharge display.

24. The device of claim 23 wherein the multi-element variable output plasma discharge display comprises:

a plurality of plasma discharge cells arrayed in a row by column matrix configuration;

a pair of hollow electrodes for each discharge cell, the pair of hollow electrodes generating, in response to a first potential, a first electric field in a gas atmosphere;

a plurality of control electrodes, one for each discharge cell, each control electrode generating, in response to a second potential, a second electric field proximate to the first electric field;

means for selectively instigating plasma discharges at selected discharge cells to generate a displayed image; and means for varying a strength of the second electric field to distort a shape of the first electric field and effectuate proportionate changes in an intensity of the instigated plasma discharges and the light output at each discharge cell for the displayed image.

25. The device of claim 24 wherein the optics comprise means for focusing the displayed image of light output from the multi-element variable output plasma discharge display on the charged photoconductive surface to generate the latent electrostatic image thereon.

26. The device of claim 25 wherein the row by column matrix comprises one row/column by multi-columns/rows, and the displayed image of light output comprises a one-dimensional image.

27. The device of claim 25 wherein the row by column matrix comprises multi-rows/columns by multi-columns/rows, and the displayed image of light output comprises a two-dimensional image.

* * * * *